US012515098B2

(12) United States Patent
Lester

(10) Patent No.: US 12,515,098 B2
(45) Date of Patent: Jan. 6, 2026

(54) METHOD AND APPARATUS FOR AN EXERCISE MACHINE

(71) Applicant: Timothy L. Lester, Smyrna, GA (US)

(72) Inventor: Timothy L. Lester, Smyrna, GA (US)

(73) Assignee: Timothy L. Lester, Smyrna, GA (US)

( * ) Notice: Subject to any disclaimer, the term of this patent is extended or adjusted under 35 U.S.C. 154(b) by 145 days.

(21) Appl. No.: 18/494,515

(22) Filed: Oct. 25, 2023

(65) Prior Publication Data

US 2024/0139584 A1 May 2, 2024

Related U.S. Application Data

(60) Provisional application No. 63/419,449, filed on Oct. 26, 2022.

(51) Int. Cl.

| | |
|---|---|
| ***A63B 23/02*** | (2006.01) |
| ***A63B 21/00*** | (2006.01) |
| ***A63B 23/025*** | (2006.01) |
| ***A63B 24/00*** | (2006.01) |
| ***A63B 71/00*** | (2006.01) |

(52) U.S. Cl.

CPC ..... *A63B 23/0238* (2013.01); *A63B 21/4034* (2015.10); *A63B 21/4047* (2015.10); *A63B 23/025* (2013.01); *A63B 24/0062* (2013.01); *A63B 24/0087* (2013.01); *A63B 71/0036* (2013.01); *A63B 2225/09* (2013.01)

(58) Field of Classification Search

CPC ..... A63B 21/4047; A63B 21/4034; A63B 21/00069; A63B 21/005; A63B 21/0083; A63B 21/0552; A63B 24/0062; A63B 24/0087; A63B 23/025; A63B 23/0238; A63B 23/0233; A63B 71/0622; A63B 71/0036; A63B 2225/09; A63B 2225/093; A63B 2225/50; A63B 2208/0233; A63B 2220/13; A63B 2220/16; A63B 2071/065; A63B 2071/0658; A63B 2024/0093; A63B 69/0062

See application file for complete search history.

(56) References Cited

U.S. PATENT DOCUMENTS 7,044,899 B2 * 5/2006 Kuo ..... A63B 21/055 482/121
10,173,102 B2 * 1/2019 Cygan ..... A63B 21/4047
(Continued)

*Primary Examiner* — Megan Anderson
*Assistant Examiner* — Jonathan A Dicuia
(74) *Attorney, Agent, or Firm* — Quinn IP Law

(57) ABSTRACT

An exercise machine includes a horizontal base portion, a first vertical post, a mechanical load system having a horizontal pivot arm arranged on second vertical post, a pivotable post, a seat, a footplate, and a kneepad assembly. The first vertical post, the second vertical post, and the pivotable post are affixed to the horizontal base portion; the seat is affixed to the second vertical post; and the footplate and the kneepad assembly are affixed to the pivotable post. The pivotable post is arranged to position the kneepad assembly in relation to the seat. The horizontal pivot arm is adjustable relative to the seat, including s first position being proximal to a lumbar region of a user, and a second position proximal to a cervical region of the user. The mechanical load system is controllable to urge a mechanical resistance to a force being exerted on the horizontal pivot arm.

19 Claims, 14 Drawing Sheets

(56) References Cited

U.S. PATENT DOCUMENTS

| | | | | |
|---|---|---|---|---|
| 2010/0304933 | A1* | 12/2010 | Donaldson | A63B 21/4047 482/130 |
| 2012/0252642 | A1* | 10/2012 | Chen | A63B 21/4033 482/121 |
| 2014/0221881 | A1* | 8/2014 | Schlauder | A63B 23/0233 601/23 |
| 2014/0296042 | A1* | 10/2014 | Snyder | A63B 21/4047 482/137 |
| 2017/0036052 | A1* | 2/2017 | Wang | A63B 21/0552 |
| 2021/0245006 | A1* | 8/2021 | Eder | G01R 1/06727 |

* cited by examiner

300

400

500

METHOD AND APPARATUS FOR AN EXERCISE MACHINE

CROSS-REFERENCE TO RELATED APPLICATIONS

This application claims the benefit of U.S. Provisional Patent Application No. 63/419,449 filed on Oct. 26, 2022, the disclosure of which is hereby incorporated by reference.

INTRODUCTION

Low back and neck pain is an increasingly widespread and expensive condition worldwide, costing the US $88 billion a year. Among adults, 60% to 80% will experience back pain and up to 70% to 75% of people will experience neck pain that interferes with their daily activities during their lifetimes. At any given time, 15% to 20% of adults will report having back pain symptoms. lower back is the second most common reason why an individual will see a doctor. One of the primary reasons for lower back pain is weak core muscles. Having an effective home exercise device that may simultaneously isolate all core muscles in one exercise motion may help strengthen the muscles that contribute to lower back pain and thus reduce chronic lower back pain.

Neck pain affects 30% to 50% of adults in the general population in any given year. Approximately 50%-85% of individuals with neck pain do not experience complete resolution of symptoms. There is a need for an effective home exercise device that may isolate and strengthen neck muscles that contribute to neck pain and thus reduce chronic neck pain.

SUMMARY

Described herein is an exercise device and system that may be advantageously employed for strengthening lumbar and cervical muscles of a user, and more specifically an exercise device and system for therapeutic muscle strengthening for lumbar and/or cervical portions of the body of a user. The disclosure provides details related to an improved device and associated system and method for exercising the lumbar and cervical muscles of the human body in a manner that may be therapeutic and/or rehabilitative.

An aspect of the disclosure includes a physical exercise machine that includes a horizontal base portion, a first vertical post, a second vertical post, a pivotable post, a seat, a footplate, and a kneepad assembly; and a user exercise system having a horizontal pivot arm and a mechanical load system. The first vertical post, the second vertical post, and the pivotable post are affixed to the horizontal base portion; the seat is affixed to the second vertical post; and the footplate and the kneepad assembly are affixed to the pivotable post. The pivotable post is arranged to pivot on the horizontal base portion to adjustably position the kneepad assembly in relation to the seat. The user exercise system is mounted on the first vertical post, with the horizontal pivot arm being coupled to the mechanical load system. The horizontal pivot arm also is adjustable to one of a first position or a second position relative to the seat, wherein the first position is proximal to a lumbar region of a user when the user is disposed on the seat, and wherein the second position is proximal to a cervical region of the user when the user is disposed on the seat. The mechanical load system is controllable to urge a mechanical resistance to a force being exerted on the horizontal pivot arm, wherein the force may be exerted by the user.

Another aspect of the disclosure may include the user exercise system being mounted on the first vertical post such that the user exercise system is rotatable in a horizontal plane to either an in-use position or a rest position.

Another aspect of the disclosure may include a controller in communication with a sensor, with the sensor being arranged to monitor a parameter associated with the horizontal pivot arm. The controller includes an instruction set that is executable to monitor the parameter associated with the horizontal pivot arm during an exercise routine, and determine, in real time, progression of the exercise routine based upon the parameter associated with the horizontal pivot arm.

Another aspect of the disclosure may include a rotation stop pin connected to the mechanical load system, wherein the rotation stop pin is arranged to control a range of motion of the horizontal pivot arm.

Another aspect of the disclosure may include the physical exercise machine having a first actuator connected to the mechanical load system, wherein the first actuator is arranged to control a range of motion of the horizontal pivot arm. A controller is operatively connected to the first actuator. The controller includes an instruction set that is executable to control the first actuator to control the range of motion of the horizontal pivot arm.

Another aspect of the disclosure may include the physical exercise machine having a second actuator that is connected to the mechanical load system. The second actuator is arranged to control a magnitude of a resistive mechanical force exertable by the mechanical load system on the horizontal pivot arm. A controller is operatively connected to the second actuator. The controller includes an instruction set that is executable to control the second actuator to control the magnitude of the mechanical resistance to the force that is being exerted on the horizontal pivot arm.

Another aspect of the disclosure may include the physical exercise machine having a second actuator that is connected to the mechanical load system. The second actuator is arranged to control a direction of a resistive mechanical force exertable by the mechanical load system on the horizontal pivot arm. A controller is operatively connected to the second actuator. The controller includes an instruction set that is executable to control the second actuator to control the direction of the mechanical resistance to the force being exerted on the horizontal pivot arm.

Another aspect of the disclosure may include a plurality of casters attached to the horizontal base portion.

Another aspect of the disclosure may include the second vertical post being configured to be adjustable in a vertical direction in relation to the horizontal base portion.

Another aspect of the disclosure may include the pivotable post being configured to be adjustable in a vertical direction in relation to the horizontal base portion.

Another aspect of the disclosure may include the mechanical load system being one of a pneumatic piston, a hydraulic piston, an elastomer band, an electromechanical resistance device, mechanical gearing, or a mechanical brake mechanism.

Another aspect of the disclosure may include a physical exercise machine that has a horizontally disposed frame, a vertical post, a horizontal base extension, a seat including a seat cushion and a back support pad; and a user exercise system, including a movable horizontal pivot arm coupled to a rotation plate, and a mechanical load system. The horizontal base extension is extendable from the frame behind the seat, and the rotation plate is rotatably coupled to the vertical post. The mechanical load system is coupled between the horizontal base extension and an eccentric point on the rotation plate, and is arranged to exert a mechanical resistance to a force being exerted on the horizontal pivot arm via the rotation plate. The vertical post, seat including seat cushion and back support pad and the user exercise system are collapsible onto the horizontally disposed frame.

Another aspect of the disclosure may include the vertical post being extendable in a vertical direction to adjust a height of the user exercise system in relation to the seat cushion.

Another aspect of the disclosure may include the physical exercise machine being arrangeable on a horizontal surface.

Another aspect of the disclosure may include the frame including a first frame portion and a second frame portion joined at a hinge, with the seat cushion including a first seat portion and a second seat portion. The first seat portion is disposed on the first frame portion and the second seat portion is disposed on the second frame portion. The first frame portion and the first seat portion are coplanar with the second frame portion and the second seat portion when the physical exercise machine is arranged in an in-use state. The first frame portion and the first seat portion are arranged in parallel with the second frame portion and the second seat portion via the hinge when the physical exercise machine is arranged in a collapsed state.

Another aspect of the disclosure may include the horizontal base extension having a tube portion that is telescopically joined to the horizontally disposed frame.

Another aspect of the disclosure may include the horizontal base extension having attachable, collapsible or pivoting legs that are joined to the horizontally disposed frame.

Another aspect of the disclosure may include the mechanical load system being a piston that is coupled between the horizontal base extension and the rotation plate.

Another aspect of the disclosure may include the mechanical load system being one of a pneumatic piston, a hydraulic piston, an elastomer band, an electromechanical resistance device, mechanical gearing, or a mechanical brake mechanism.

Another aspect of the disclosure may include the horizontal pivot arm being adjustable to one of a first position or a second position relative to the seat, wherein the first position is proximal to a lumbar region of a user disposed on the seat, and wherein the second position is proximal to a cervical region of the user disposed on the seat.

Another aspect of the disclosure may include the user exercise system being mounted on the vertical post such that the user exercise system is rotatable in a horizontal plane to either an in-use position or a rest position.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the claims.

BRIEF DESCRIPTION OF THE DRAWINGS

One or more embodiments will now be described, by way of example, with reference to the accompanying drawings, in which.

Figure 1:
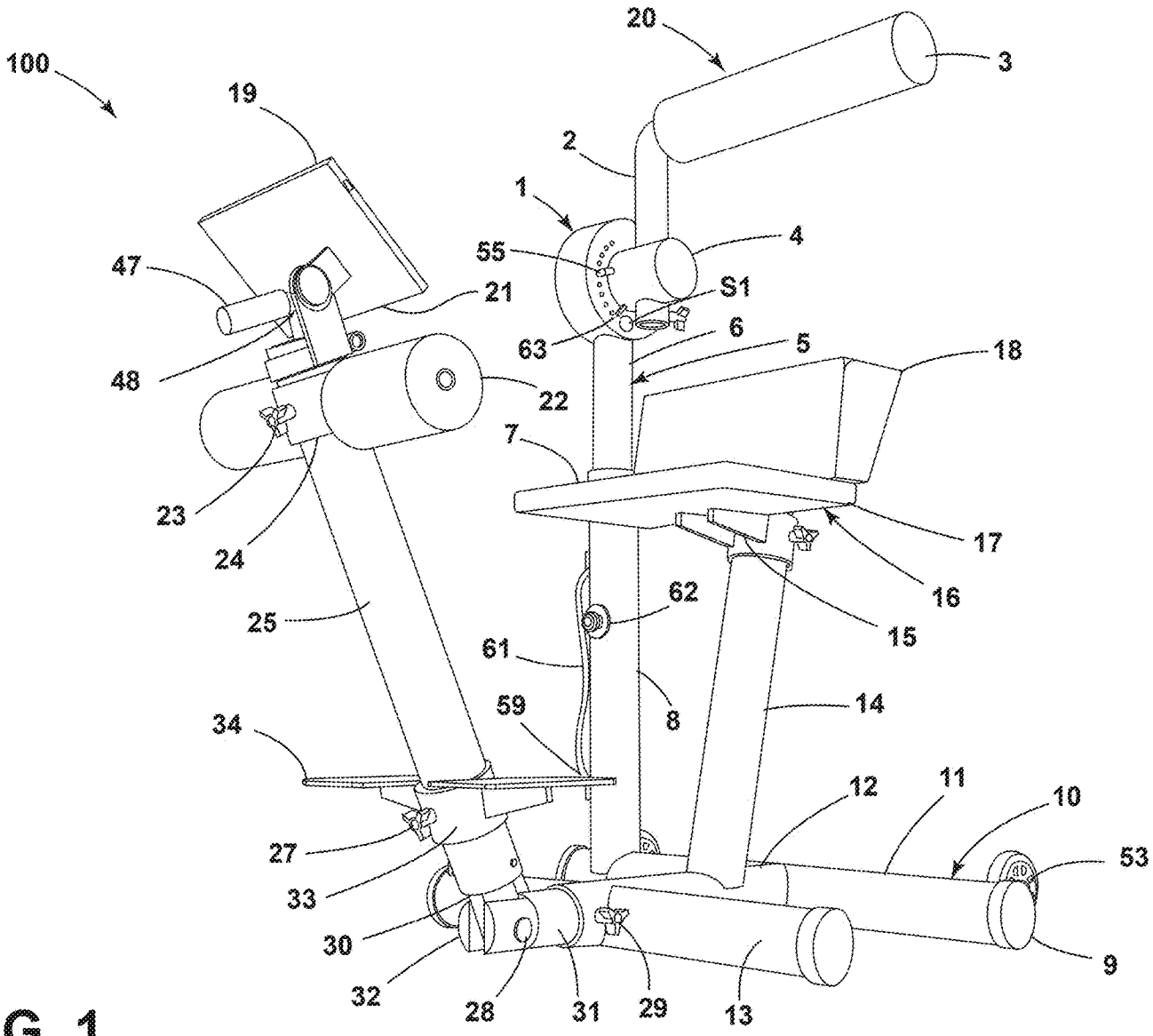
FIG. 1 schematically illustrates a front perspective view of an embodiment of a physical exercise machine, in accordance with the disclosure.

The appended drawings are not necessarily to scale, and may present a somewhat simplified representation of various features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description to provide a thorough understanding of the embodiments disclosed herein, some embodiments may be practiced without some of these details. Moreover, for the purpose of clarity, certain technical material that is understood in the related art has not been described in detail to avoid unnecessarily obscuring the disclosure.

Furthermore, the drawings are in simplified form and are not to precise scale. For purposes of convenience and clarity, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein.

The following detailed description is merely illustrative in nature and is not intended to limit the application and uses. Furthermore, there is no intention to be bound by any expressed or implied theory presented herein. Throughout the drawings, corresponding reference numerals indicate like or corresponding parts and features.

For the sake of brevity, conventional components and techniques and other functional aspects of the systems (and the individual operating components of the systems) may not be described in detail herein. Furthermore, the connecting lines shown in the various figures contained herein are intended to represent example functional relationships and/or physical couplings between the various elements. Many alternative or additional functional relationships or physical connections may be present in an embodiment.

The use of ordinals such as first, second and third does not necessarily imply a ranked sense of order, but rather may distinguish between multiple instances of an act or structure.

All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiments.

Figure 2:
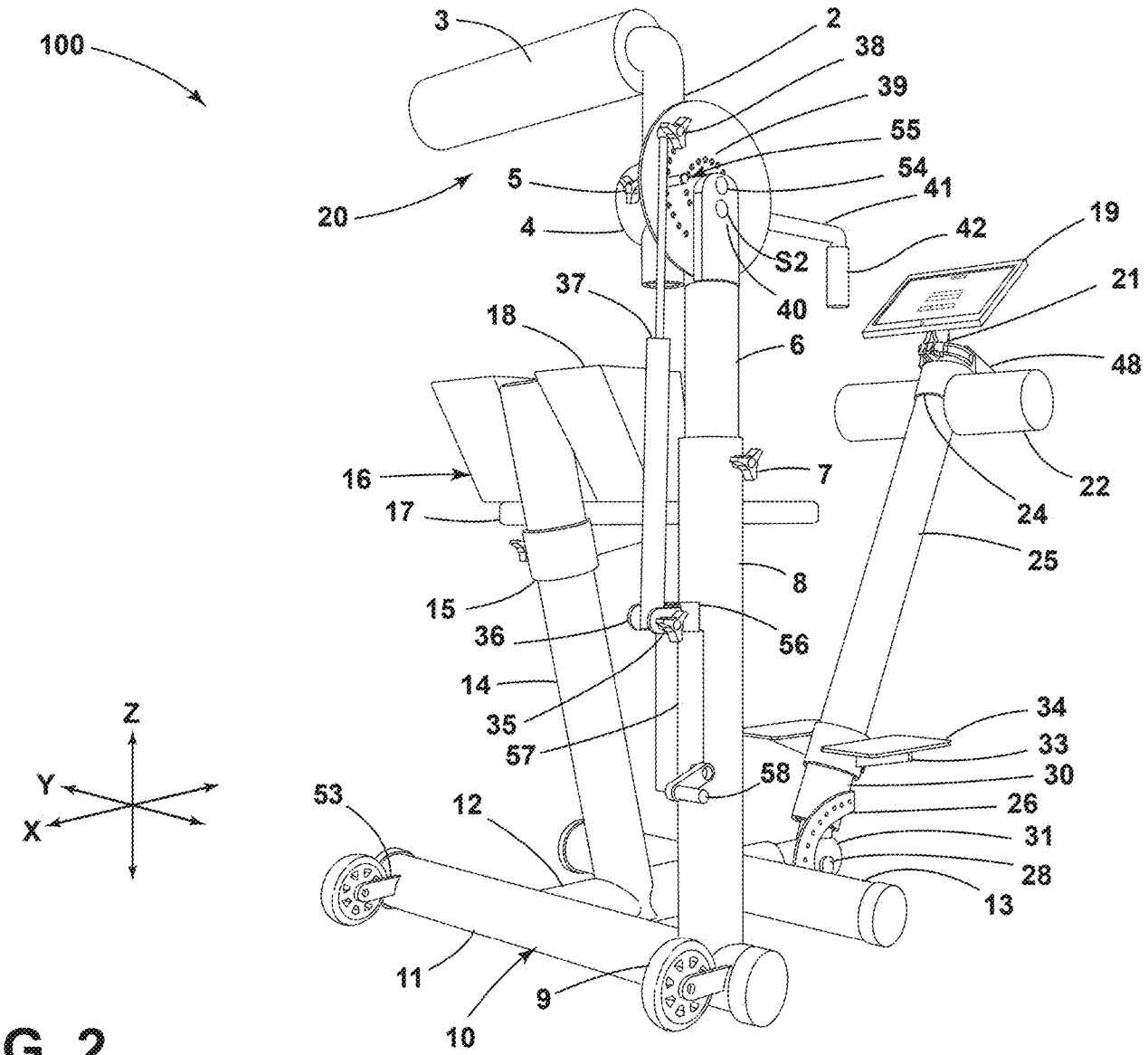
FIG. 2 schematically illustrates a rear perspective view of the embodiment of physical exercise machine that is described with reference to FIG. 1, in accordance with the disclosure.

FIGS. 1 and 2 schematically illustrate an embodiment of a physical exercise machine 100 that includes a horizontal base portion 10, a first upright or vertical post 5, a second vertical post, i.e., seat post 14, a pivotable post 25 including a footplate 34 and a kneepad assembly 24, a seat 16 that includes a seat cushion 17 and a back support pad 18, and a user exercise system 20. The first vertical post 5, the second vertical post 14, and the pivotable post 25 are affixed to the horizontal base portion 10. The seat 16 including the seat cushion 17 and back support pad 18 are affixed to the second vertical post 14. The footplate 34 and the kneepad assembly 24 are affixed to the pivotable post 25. The pivotable post 25 is arranged to pivot on the horizontal base portion 10 to adjustably position the kneepad assembly 24 in relation to the seat 16, and is positionable in an at-rest position and an in-use position.

The user exercise system 20 is mounted on the first vertical post 5. The user exercise system 20 has a horizontal pivot arm 2 that is coupled to a mechanical load system 1.

The horizontal pivot arm 2 is vertically rotatably coupled to the mechanical load system 1. The horizontal pivot arm 2 is adjustable to one of a first vertical position or a second vertical position relative to the seat 16, wherein the first vertical position is proximal to a lumbar region of a user when disposed on the seat 16, and wherein the second vertical position is proximal to a cervical region of the user when disposed on the seat 16. The mechanical load system 1 is controllable to urge a mechanical resistance in opposition to a force being exerted on the horizontal pivot arm 2, wherein the force being exerted on the horizontal pivot arm 2 may be in the form of a user who is engaged in an exercise routine. The horizontal pivot arm 2 of the user exercise system 20 is also rotatable in a horizontal plane to either an in-use position (as shown) or a rest position. This ability to rotate the horizontal pivot arm 2 in the horizontal plane combined with the ability to pivot the pivotable post 25 on the horizontal base portion 10 to adjustably position the kneepad assembly 24 in relation to the seat 16 facilitates user ingress/egress to the seat 16 prior to beginning an exercise routine and after completing an exercise routine.

Figure 3:
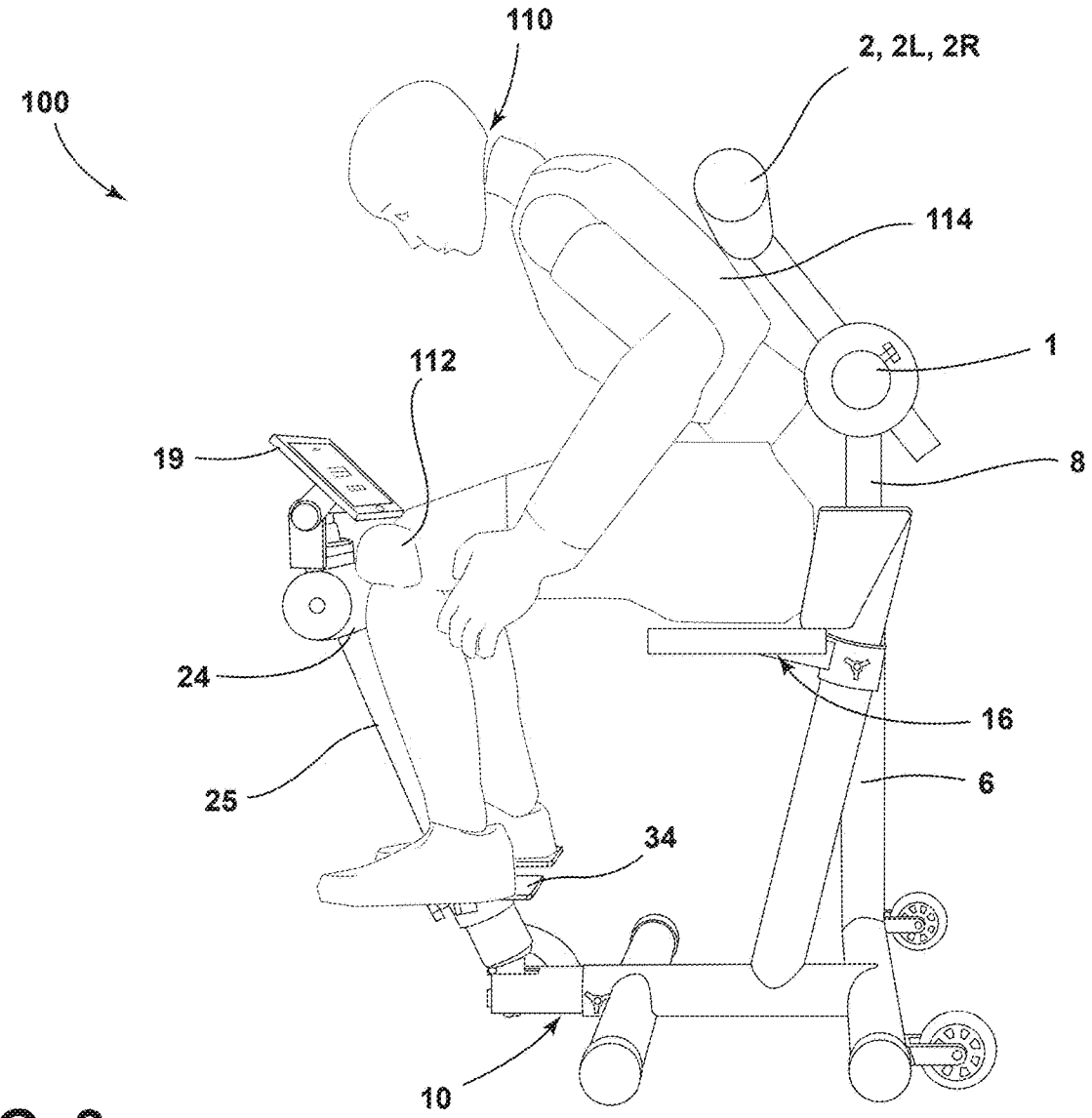
FIG. 3 pictorially illustrates a side view of the embodiment of the physical exercise machine that is described with reference to FIGS. 1 and 2, including a user disposed in an exercise-start position, in accordance with the disclosure.

FIG. 3 pictorially illustrates a side view of the embodiment of the physical exercise machine 100 that is described with reference to FIGS. 1 and 2. This includes user 110 being seated on seat 16, with the pivotable post 25 being pivoted on the horizontal base portion 10 to an in-use position to adjustably position the kneepad assembly 24 in relation to the seat 16 and in contact in front of the user's knees 112. The horizontal pivot arm 2 that is coupled to the mechanical load system 1 is disposed in a first in-use position 2L, which is proximal to a lumbar area 114 of the user 110, and thus facilitates lumbar exercises. The horizontal pivot arm 2 is disposed at an at-rest position 2R, wherein the mechanical load system 1 is not exerting mechanical resistance to force being exerted on the horizontal pivot arm 2, wherein the force may be exerted by the user 110 during exercise.

Figure 4:
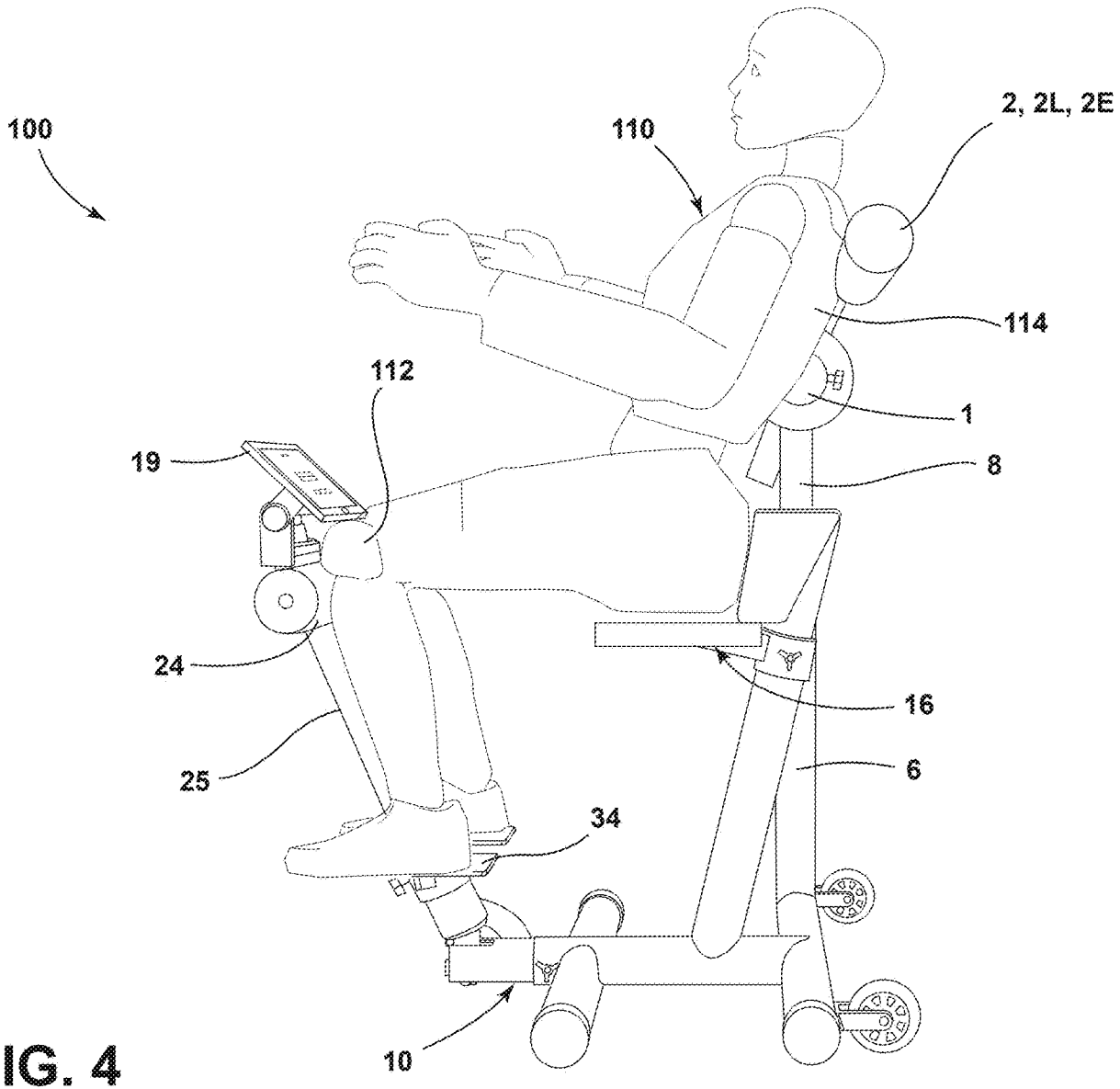
FIG. 4 pictorially illustrates a side view of the embodiment of the physical exercise machine that is described with reference to FIGS. 1 and 2, including a user disposed in an exercise-extended position, in accordance with the disclosure.

FIG. 4 pictorially illustrates another side view of the embodiment of the physical exercise machine 100 that is described with reference to FIGS. 1 and 2. This includes user 110 being seated on seat 16, with the pivotable post 25 being pivoted on the horizontal base portion 10 to an in-use position to adjustably position the kneepad assembly 24 in relation to the seat 16 and in contact in front of the user's knees 112. The horizontal pivot arm 2 that is coupled to the mechanical load system 1 is disposed in the first in-use position 2L, which is proximal to a lumbar area 114 of the user 110, and thus facilitates lumbar exercises. The horizontal pivot arm 2 is at an extended position 2E, wherein the mechanical load system 1 is able to urge a mechanical resistance to a force being exerted on the horizontal pivot arm 2, such as may be exerted by the user 110.

Figure 5:
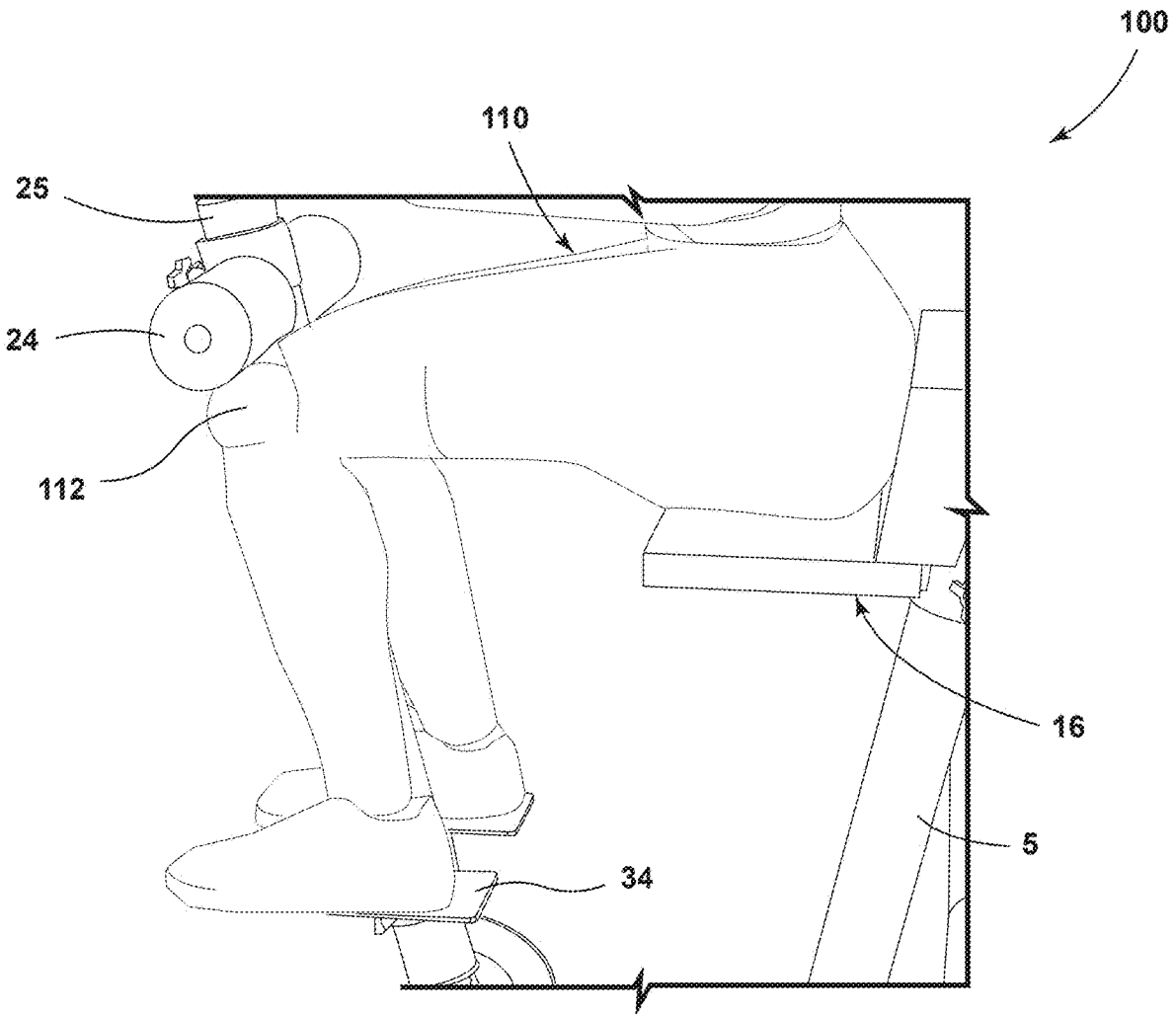
FIG. 5 pictorially illustrates a partial side view including a pivotable post, footplate, and kneepad assembly of the embodiment of the physical exercise machine that is described with reference to FIGS. 1 and 2, including the kneepad assembly being arranged overtop of the knees of a user, in accordance with the disclosure.

FIG. 5 pictorially illustrates a partial side view of the embodiment of the physical exercise machine 100 that is described with reference to FIGS. 1 and 2. This includes the pivotable post 25 including footplate 34 and kneepad assembly 24 including the kneepad assembly 24 being arranged overtop of the knees 112 of user 110, thus restraining the knees 112 or holding the knees 112 in place from above through the use of the kneepad assembly 24.

Figure 6:
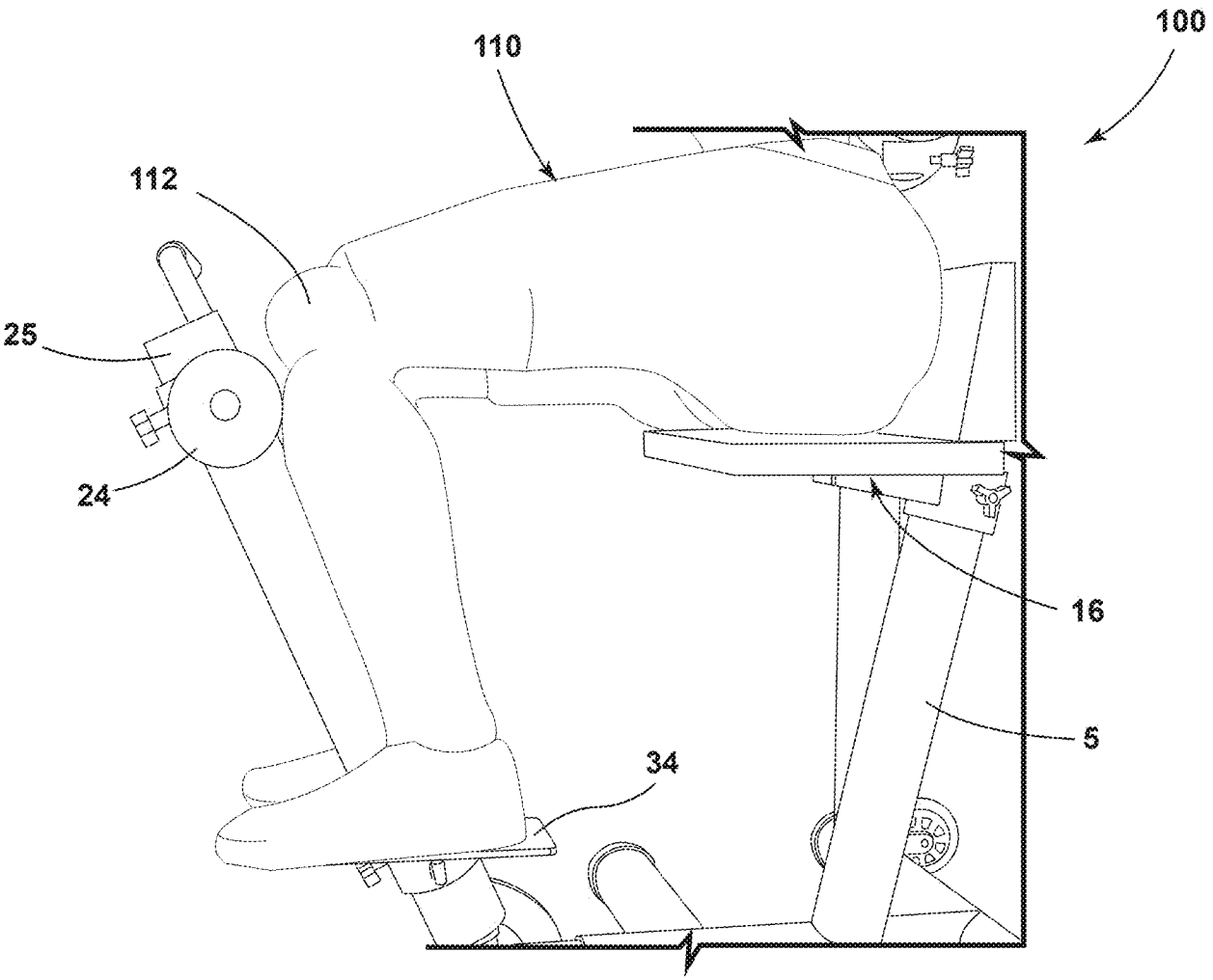
FIG. 6 pictorially illustrates a partial side view including a pivotable post, footplate, and kneepad assembly of the embodiment of the physical exercise machine that is described with reference to FIGS. 1 and 2, including the kneepad assembly being arranged in front of the knees of a user, in accordance with the disclosure.

FIG. 6 pictorially illustrates a partial side view of the embodiment of the physical exercise machine 100 that is described with reference to FIGS. 1 and 2. This includes the pivotable post 25 including footplate 34 and kneepad assembly 24 including the kneepad assembly 24 being arranged in front of the knees 112 of user 110, thus restraining the knees 112 or holding the knees 112 in place through the use of the kneepad assembly 24.

It is appreciated that other embodiments may allow the pads to secure the knees simultaneously above and in front of the knee. Similarly, an additional pad may be added to allow popliteal support behind the knees.

Figure 7:
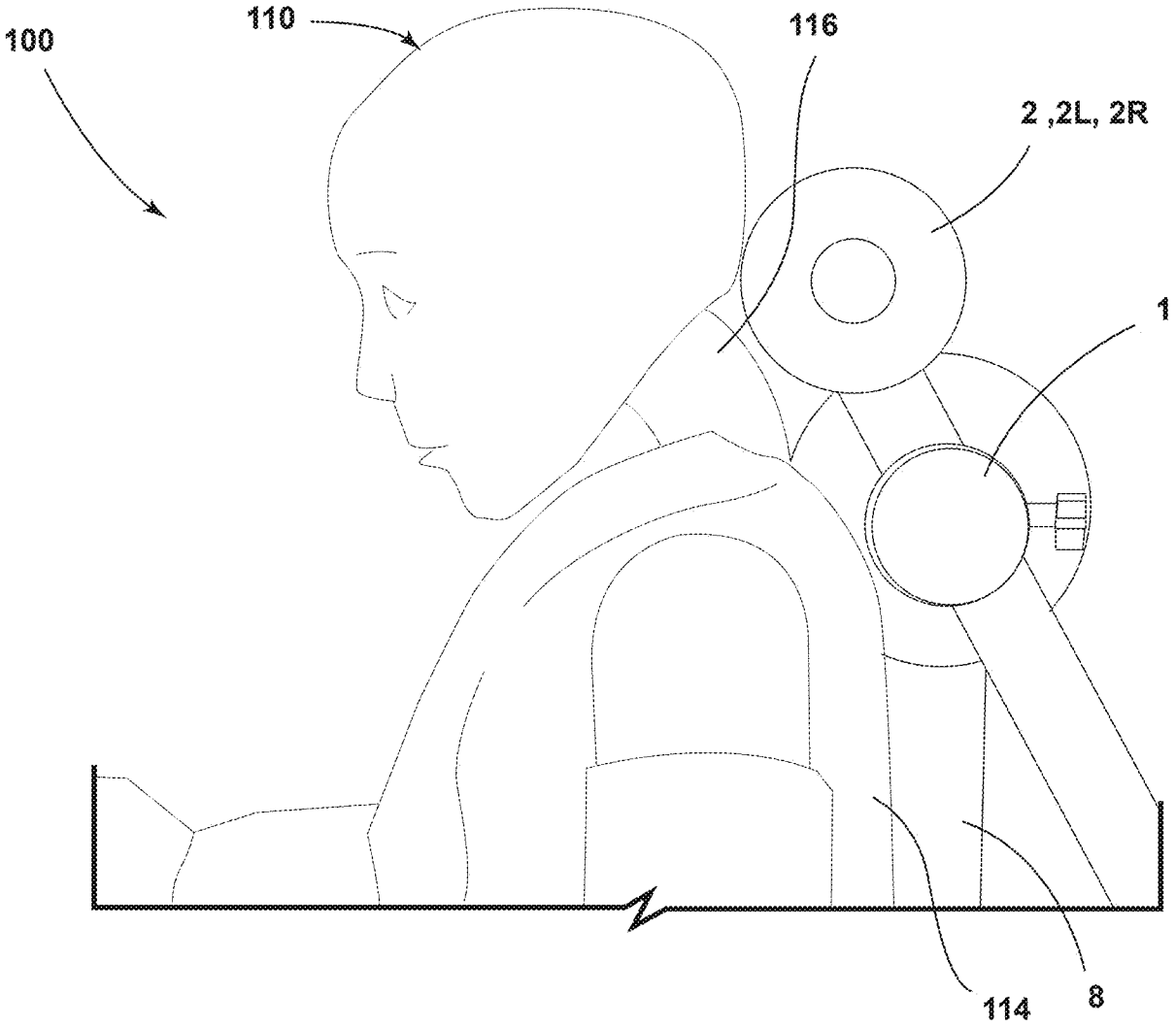
FIG. 7 pictorially illustrates a partial side view including a horizontal pivot arm and mechanical load system of the embodiment of the physical exercise machine that is described with reference to FIGS. 1 and 2, including the horizontal pivot arm being arranged proximal to a cervical area of a user in an exercise-start position, in accordance with the disclosure.

FIG. 7 pictorially illustrates a side view of the embodiment of the physical exercise machine 100 that is described with reference to FIGS. 1 and 2. This includes user 110 being seated on the seat (not shown in this illustration). The horizontal pivot arm 2 that is coupled to the mechanical load system 1 is disposed in a second in-use position 2C, which is proximal to a cervical area 116 of the user 110, and thus facilitates cervical exercises. The horizontal pivot arm 2 is disposed at an at-rest position 2R, wherein the mechanical load system 1 is not exerting mechanical resistance to force being exerted on the horizontal pivot arm 2, wherein the force may be exerted by the user 110 during exercise.

Figure 8:
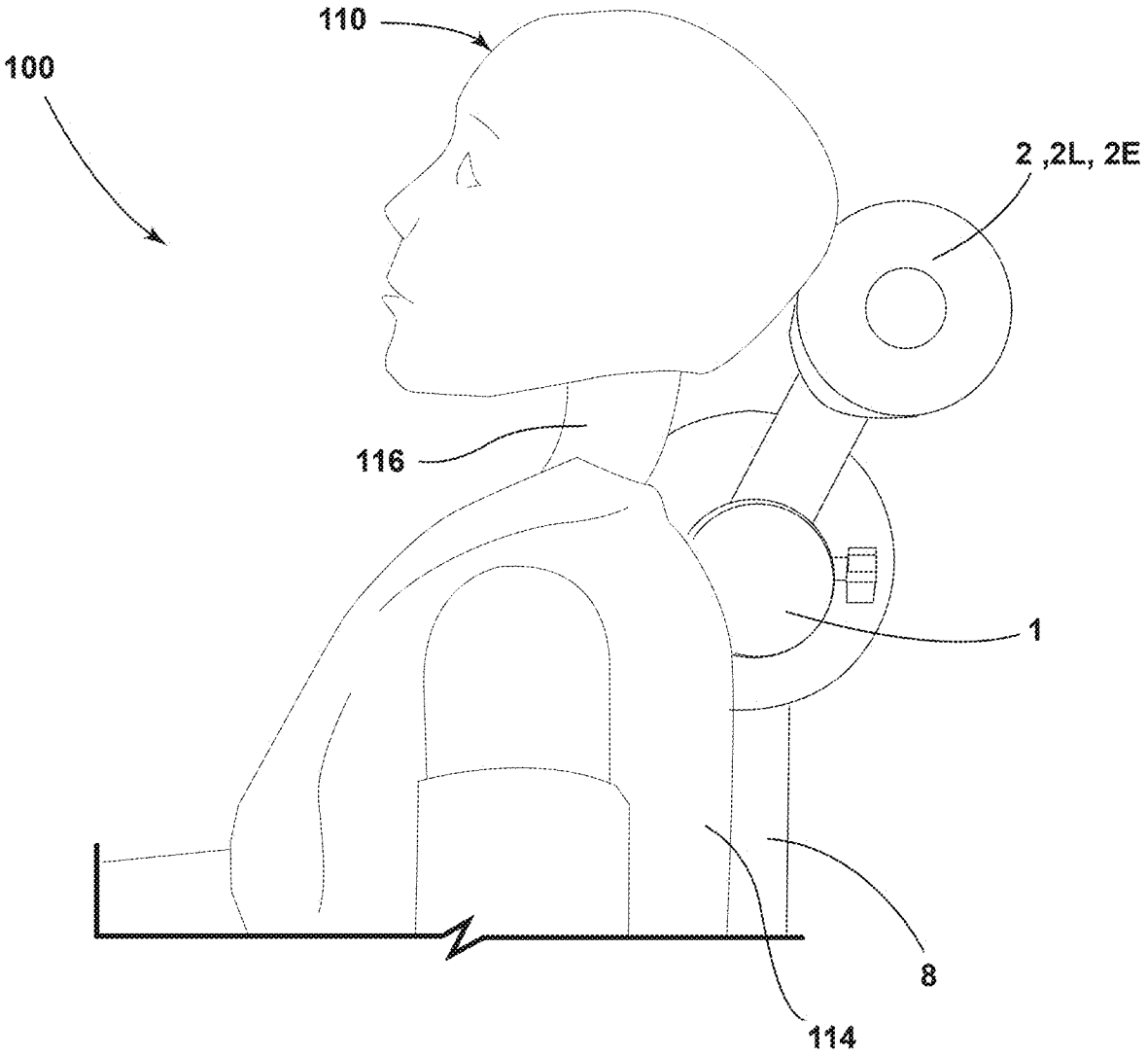
FIG. 8 pictorially illustrates a partial side view including a horizontal pivot arm and mechanical load system of the embodiment of the physical exercise machine that is described with reference to FIGS. 1 and 2, including the horizontal pivot arm being arranged proximal to a cervical area of a user in an exercise-extended position, in accordance with the disclosure.

FIG. 8 pictorially illustrates a side view of the embodiment of the physical exercise machine 100 that is described with reference to FIGS. 1 and 2. This includes user 110 being seated on the seat (not shown in this illustration). The horizontal pivot arm 2 that is coupled to the mechanical load system 1 is disposed in a second in-use position 2C, which is proximal to a cervical area 116 of the user 110, and thus facilitates cervical exercises. The horizontal pivot arm 2 is disposed at an extended position 2E, wherein the mechanical load system 1 is exerting mechanical resistance to force being exerted on the horizontal pivot arm 2, wherein the force may be exerted by the user 110 during exercise.

More detailed descriptions of the elements that are illustrated in FIGS. 1 through 8 include as follows.

Mechanical load system 1 includes the resistance producing mechanism or controllable resistance device. The mechanical load system 1 is a controllable mechanical resistance or load device in the form of a pneumatic piston, a hydraulic piston, an elastomer band, an electromechanical resistance device, mechanical gearing, a mechanical brake mechanism, or another device.

In one embodiment, the mechanical load system 1 includes a position sensor arranged to monitor movement of the horizontal pivot arm 2.

In one embodiment, the mechanical load system 1 includes a position sensor S1 arranged to monitor movement of the horizontal pivot arm 2.

In one embodiment, the mechanical load system 1 includes a second actuator that is arranged to control a magnitude of a resistive mechanical force that is exertable by the mechanical load system on the horizontal pivot arm.

In one embodiment, the position sensor S1, the first actuator, and/or the second actuator of mechanical load system 1 may be in communication with controller 19, wherein communication may be two-way communication or one-way Horizontal pivot arm 2 rotates around a pivot to allow movement along the z-axis.

Foam pad/cover 3 for the horizontal pivot arm 2 provides cushion against the pressure exerted by the horizontal pivot arm.

Rotation axle 4 provides an attachment point for the horizontal pivot arm 2 to attach to the mechanical load system 1. It also allows the horizontal pivot arm 2 to be adjusted up and down along the y-axis through the use of an attachment pin, which is used to secure the horizontal pivot arm 2 to the rotation axle 4.

The first vertical post 5 is formed by a base adjustment tube 8 and a second adjustment tube 6, which have a telescopic arrangement in one embodiment.

The base adjustment tube 8 and the second adjustment tube 6 facilitate up/down adjustment of the first vertical post 5 in the y-axis so that the mechanical load system 1 may be fitted to users based upon their heights. In one embodiment, it may be adjusted by at least 12 inches (30 cm), which allows adjustment to the first in-use position 2L (illustrated with reference to FIGS. 3 and 4) and the second in-use position 2C (illustrated with reference to FIGS. 7 and 8), thus facilitating exercises used to strengthen the lumbar muscles (L) and the cervical neck muscles (C). The tube is held in position in the y-axis through the use of an attachment pin 7. Attachment pin 7 is employed to secure the adjustment tube 6 to base adjustment tube 8.

The base adjustment tube 8 is attached to horizontal base 10.

The horizontal base 10 includes rear base tube 11, central base tube 12, and front base tube 13.

Transportation wheels 9 include a pair of wheels or casters that are attached to the rear base tube 11 to allow the physical exercise machine 100 to be tilted and easily moved. Alternatively, multiple wheels, rollers, casters, sliders, may be employed, without limitation.

Seat post 14 is a tubular frame member that is attached to the central base tube 12 and gives the seat bracket a point of attachment that allows the seat cushion 17 to be adjusted up and down in the vertical (y-axis) so that the device may be fitted to various sized individuals. Also serves as an attachment point for the back support pad 18.

Seat bracket 15 is a bracket attachment that slides up and down the seat post and holds the seat cushion 17 in place.

Seat 16 has attachment pin that is to secure the seat bracket 15 to the seat post 14 via alignment holes.

Seat cushion 17 is a cushioned pad or upholstered seat that attaches to the seat bracket 15 and provides a place for the user to sit.

Back support pad 18 is a foam cushion or upholstered pad that is used to firmly support the back of the user against the seat post 14 to prevent the user from sliding backward. The seat cushion and back support pad form a seat.

Controller 19 includes A) monitoring function (counting reps, magnitude of resistance, range of motion, etc.), B) control function (magnitude of resistance and range of motion) and C) reporting out function (to home computer or to a trainer). In one embodiment and as shown, controller 19 is a tablet.

The controller 19 is linked to the mechanical load system 1 which may include, in one embodiment, a sensor (through the use of a wired connection, an infrared connection, a radio frequency connection, a Bluetooth connection, cellular connection or a WiFi connection) and used to control a position, resistance or other parameter of the controllable resistance device. It may also be used to monitor and capture usage information, such as frequency of use, duration of use, history of use, range of motion information, resistance levels and range of motion or strength improvement over time. Further, some embodiments, such as those not using electromechanical resistance, may use this as an electronic computerized instructional device or application linked to the device to set up training routines or regimens for the user. A controller adjustment collar attaches to the pivotable post 25. A controller bracket is employed when attaching a tablet or electronic interface device to the front of the device, it is used to attach the tablet or electronic interface device and position it so that the tablet or electronic interface device does not prevent exercise.

A kneepad assembly 24 is used to lock the user's knees into place, it may be adjusted up and down (move along the y-axis) to accommodate different size users. It may be locked in place using the attachment pin 23. Kneepads 22 are used to cushion the user's knees. They cover the bar portion of the kneepad assembly 24. An attachment pin is used to secure the kneepad assembly 24 into place on the pivotable post 25.

A pivotable post 25 is used to lock the user's knees into place employing the kneepad assembly 24. The pivotable post 25 may be pivoted in towards or away from the user (z-axis) to allow the kneepad assembly 24 to be locked into position. In the present configuration it is angled so that the angle at the rear of the pivotable post 25 forms an acute angle with the central base tube 12. However, other configurations may form ninety-degree angles or obtuse angles.

Pivot bar retaining body 26 is used to lock the pivotable post into place with a locking pin 39. It is permanently attached to the central base tube 12.

Attachment pin 27 is used to secure the footplate adjustment bracket 3*e* to the pivotable post 25.

Pivot bar hinge pin 28 allows the pivotable post 25 to pivot forward and backward (in the z-axis). The pivot bar hinge pin 28 connects the pivotable post 25 with the central base tube 12.

Attachment pin 29 is used to secure the central base tube extension 31 to the central base tube 12.

Pivot 30 allows the pivotable post 25 to rotate within the pivotable post pivot base 32.

Central base tube extension 31 is used to allow the pivotable post 25 and the attached footplates 34 and kneepad assembly 24 to be adjusted away from or closer to the user (along the z-axis).

Pivotable post pivot base 32 allows the pivot 30 to rotate within the pivotable post pivot base 32, which allows the limited rotation of the pivotable post 25 in relation to the central base tube extension 31 and central base tube 12.

Footplate adjustment bracket 33 attaches to the pivotable post 25 with the attachment pin 27 to allow the footplate adjustment bracket 33 to be moved up or down (along the y-axis) to accommodate different size users.

The footplate 34 is used to support the user's feet while using the device. It attaches to the footplate adjustment bracket 33.

Attachment pin 35 may be used to secure the piston 37 to the piston attachment bracket 36.

Piston attachment bracket 36 attaches to piston adjustment tube (upper) 56 and serves as the attachment point for the lower end of the piston 37.

Piston 37 is a pre-charged pneumatic or hydraulic cylinder that may be charged to various pressure levels to provide different resistance values. This provides the resistance force for this embodiment of the piston version of the device. One end of the piston 37 is secured to an eccentric connection point 38 of the rotation retaining plate 39 via an attachment pin. Different connection points may be spaced along the base adjustment tube 8 to accommodate adjustment of the adjustment tube 6.

Rotation retaining plate 39 serves as the connection point for the piston 37 and the rotation retaining plate 39 rotates around the horizontal pivot arm pivot bearing 54. This rotation allows the horizontal pivot arm 2 to rotate as the resistance housing rotation axle 4 rotates around the horizontal pivot arm pivot bearing 54. When disengaged with a rotation release locking pin (not shown), it will allow the horizontal pivot arm 2 to rotate freely. When engaged with the rotation release locking pin, it will allow the horizontal pivot arm 2 to rotate or under load (resistance). It is also where the rotation stop-pin 55 is engaged to stop the rotation of the horizontal pivot arm 2 at a predetermined interval, which is associated with a range of motion (ROM).

Horizontal pivot arm pivot mount 40 is attached to the second adjustment tube 6, providing an attachment point for the horizontal pivot arm pivot bearing 54, about which the rotation retaining plate 39, the horizontal pivot arm 2 and the resistance housing rotation axle 4 all rotate.

Rotation release handle 41 is used to release the horizontal pivot arm 2, permitting it to pivot in towards the user (z-axis) for setting the in-use position, pivot out to an entrance position from the user (z-axis) to permit user ingress and egress. Rotating the rotation release handle 41 half a turn rotates a rotation release cam that allows a rotation release pin to push against a rotation release locking pin (not shown). This pulls the rotation release locking pin out of the hole that allows it to lock to the rotation retaining plate 39. This also compresses a rotation release spring, which pushes the rotation release locking pin back into a locked position when the force is released, i.e., the rotation release handle 41 is rotated back to the starting position.

Rotation release handle grip cover 42 is a device fabricated from foam or similar material used to allow the rotation release handle 41 to be more easily gripped.

Rotation release cam is a cam mechanism that is permanently attached to and rotates as the rotation release handle 41 is rotated. This rotation translates the rotation of the rotation release handle 41 into a side-to-side motion (along the x-axis) of the rotation release locking pin which allows it to engage or disengage with the rotation retaining plate 39 to either lock or release the pivotable post 25.

Rotation release pin is attached to the rotation release locking pin and rides inside the groove on the rotation release cam to translate the rotation of the rotation release handle 41 into a side-to-side motion (along the x-axis) of the rotation release locking pin. This allows it to engage or disengage with the rotation retaining plate 39 to either lock or release the horizontal pivot arm 2. The rotation release locking pin engages with the rotation retaining plate 39 to either lock or release the horizontal pivot arm 2. The rotation release spring surrounds the rotation release locking pin. As the rotation release cam translates the rotation of the rotation release handle 41 into movement of the rotation release locking pin the rotation release spring is compressed to provide stored energy to force the release locking pin back into a hole on the rotation retaining plate 39 to lock the horizontal pivot arm 2 into place.

Pivotable post release handle 47 is used to release the pivotable post 25, so that it may pivot in towards or away from the user (z-axis) to allow the kneepad assembly 24 to be locked into position. Rotating the pivotable post release handle 47 half a turn rotates a cam that allows a pivotable post release pin to push against a pivotable post release locking pin. This pulls the pivotable post release locking pin out of the hole that allows it to lock to the pivotable post retaining body 26. This also compresses a pivotable post release spring, which pushes the pivotable post release locking pin back into a locked position when the force is released, i.e., the pivotable post release handle 47 is rotated back to the starting position. Pivotable post release handle grip cover 48 is a device fabricated from foam or similar material used to allow the pivotable post release handle 47 to be more easily gripped.

Pivotable post release cam is a cam mechanism that is permanently attached to and rotates as the pivotable post release handle 47 is rotated. This rotation translates the rotation of the pivotable post release handle 47 into a side-to-side motion (along the x-axis) of the pivotable post release locking pin which allows it to engage or disengage with the pivotable post retaining body 26 to either lock or release the pivotable post 25.

Pivotable post release pin is attached to the pivotable post release locking pin and rides inside the groove on the pivotable post release cam to translate the rotation of the pivotable post release handle 47 into a side-to-side motion (along the x-axis) of the rotation release locking pin. This allows it to engage or disengage with the rotation retaining plate 39 to either lock or release the horizontal pivot arm 2.

The pivotable post release locking pin engages with the pivotable post retaining body 26 to either lock or release the pivotable post 25.

The pivotable post release spring surrounds the pivotable post release locking pin. As the pivotable post release cam translates the rotation of the pivotable post release handle 47 into movement of the pivotable post release locking pin, the pivotable post release spring is compressed to provide stored energy to force the pivotable post release locking pin back into a hole on the pivotable post retaining body 26 to lock the pivotable post 25 into place.

Wheel attachment bracket 53 connects the transportation wheels 9 to the rear base tube 11, allowing the device to be easily transported.

Horizontal pivot arm pivot bearing 54 provides a pivot point which allows the pivotable post 2 and resistance housing rotation axle 4 to rotate.

Rotation stop-pin 55 connects to the rotation retaining plate 39 and is used to stop the rotation of the pivotable post 25 (at a predetermined point) by contacting the Horizontal pivot arm pivot mount 40. In one embodiment, the rotation stop-pin connects to the mechanical load system 1 and is used to stop the rotation of the resistance housing rotation axle 4 and the horizontal pivot arm 2 (at a predetermined point) by coming into contact with the rotation stop arm 63.

Piston adjustment tube (upper) 56 is employed to mount the piston attachment bracket 36 to allow the stroke of the piston to be adjusted up and down along the y-axis.

Piston adjustment tube (lower) 57 is mounted to the base adjustment tube 8. It holds the Piston Adjustment tube (upper) 56, which allows the stroke of the piston to be adjusted up and down along the y-axis by cranking the Piston adjustment handle 58. If the device is configured for working the neck (cervical) muscles, then this element may have an alternate mounting position higher up (in the y-axis) on the electromechanical resistance housing base adjustment tube 8.

Piston adjustment handle 58 is used to adjust the stroke of the piston up and down along the y-axis. Turning the handle actuates an internal mechanism that moves the piston adjustment tube (lower) 57 up and down, within the piston adjustment tube (upper) 56. The crank mechanism may take on a number of different configurations using beveled gears, ring and screen gears, pinion and rack gears or other configurations.

Cord hanger 59 includes an upper and lower loop and is used to stow/wrap the electrical cord 61 for transportation or storage, when employed. Electrical cord 61 is used to provide power to the mechanical load system 1 in some embodiments.

Emergency stop switch 62 is used to immediately cease energization of the resistance producing mechanism in a version of the device that does not use pistons. This mechanism is housed in the mechanical load system 1. This is connected to the electrical cord 61 directly, externally, or via internal wiring (not shown) routed through the tubing, second adjustment tube 6 and the base adjustment tube 8.

Rotation stop arm 63 is attached to the resistance housing rotation axle 4. It stops the rotation of the resistance housing rotation axle 4 and the Horizontal pivot arm 2 (at a predetermined point) by preventing the resistance housing rotation axle 4 and the horizontal pivot arm 2 from rotating when the rotation stop arm 63 comes into contact with the rotation stop-pin 55.

Pivot 30 rotates around a pivot point at pivotable post hinge pin 28, to allow the kneepads 22 and kneepad assembly 24 to secure the knees in front of or above the knees. A modification in the design may allow the pads to secure the knees simultaneously above and in front of the knee. Similarly, an additional pad may be added to allow popliteal support behind the knees.

Pivotable post release handle 47 is used to disengage the rotation release locking pin, which slides into holes on the pivotable post retaining body 26 to lock the pivotable post 25 into an in-use position. This may be accomplished via a cable release like a bike brake handle, or a spring-loaded pin similar to a button handle locking pin or a mechanism. In one embodiment, and as shown, a cammed, twist handle is employed to release the pin. Disengaging the locking mechanism will allow the pivotable post 25 to be tilted into position to lock the user's knees into place in-use or to move away from the patient's knees after an exercise routine is complete. Re-engaging the pivotable post release handle 47 locks the pivotable post 25 into position for exercising, in the in-use position. At the end of exercise, the pivotable post release handle 47 may be used to release the pivoting member so that it may be returned to the rest position.

The foregoing elements may be fabricated from tubular steel, black pipe, bar stock, beam stock or similar elongated hollow pieces with cross-sections that are round, square, rectangular, I-beam, C-beam, T-beam or other, without limitation. The pieces may instead be fabricated from aluminum, wood or any wood-based material, or be engineered composite materials such as plastic composites or carbon fiber, or may be any such durable materials for the aforementioned structures. Other materials may include plate or flat steel, aluminum, alloy, or other metals. The covers, grips, pads, cushions or caps for the frame or structural elements may be composed of foam, rubber, rubberized materials or plastics with similar qualities, nylon, vinyl or other plastics. They may also be composed of a combination of several materials.

Figure 9:
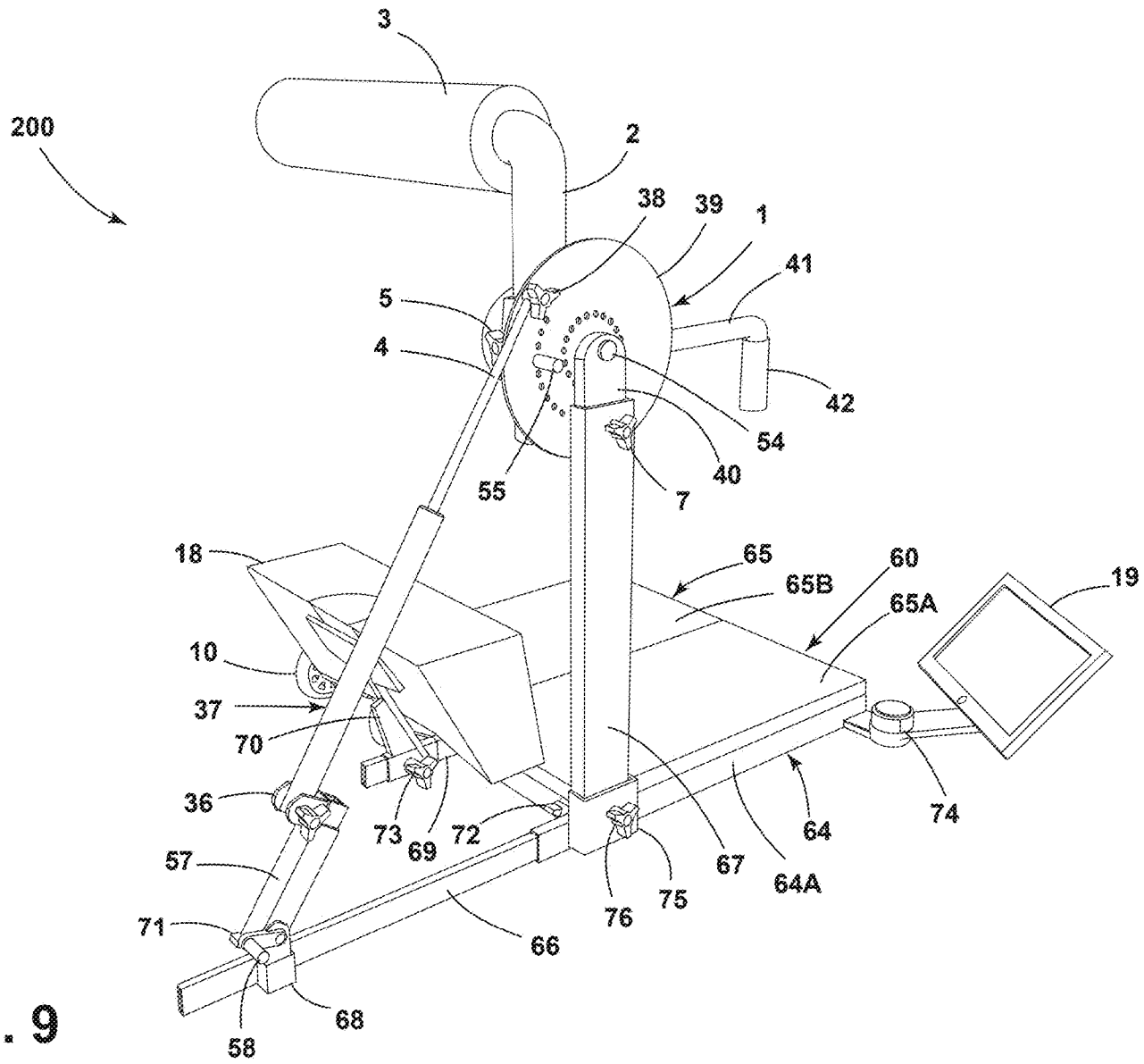
FIG. 9 schematically illustrates a rear perspective view of an embodiment of a floor-mounted physical exercise machine, in accordance with the disclosure.
Figure 10:
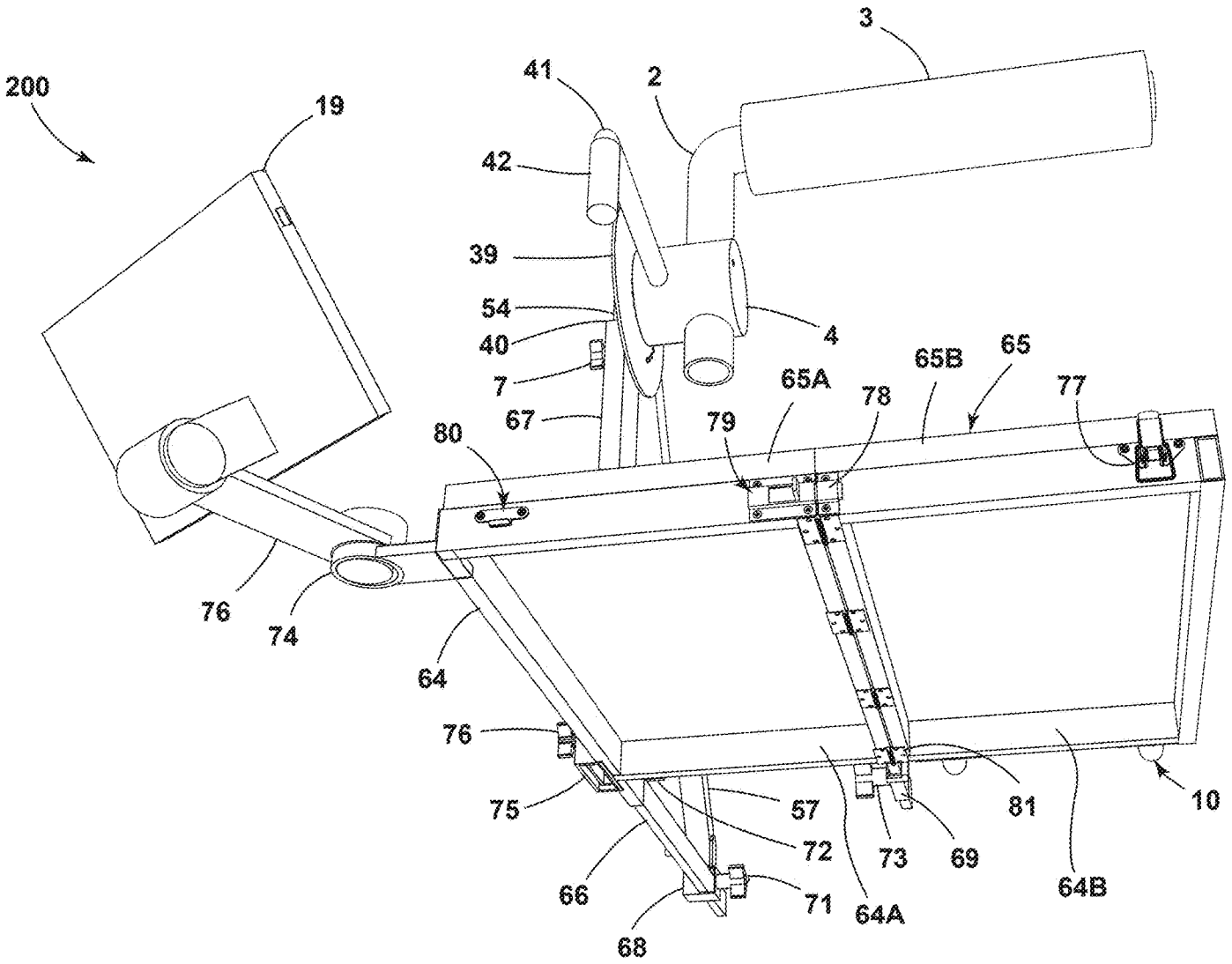
FIG. 10 schematically illustrates a front-bottom perspective view of an embodiment of a floor-mounted physical exercise machine, in accordance with the disclosure.
Figure 11:
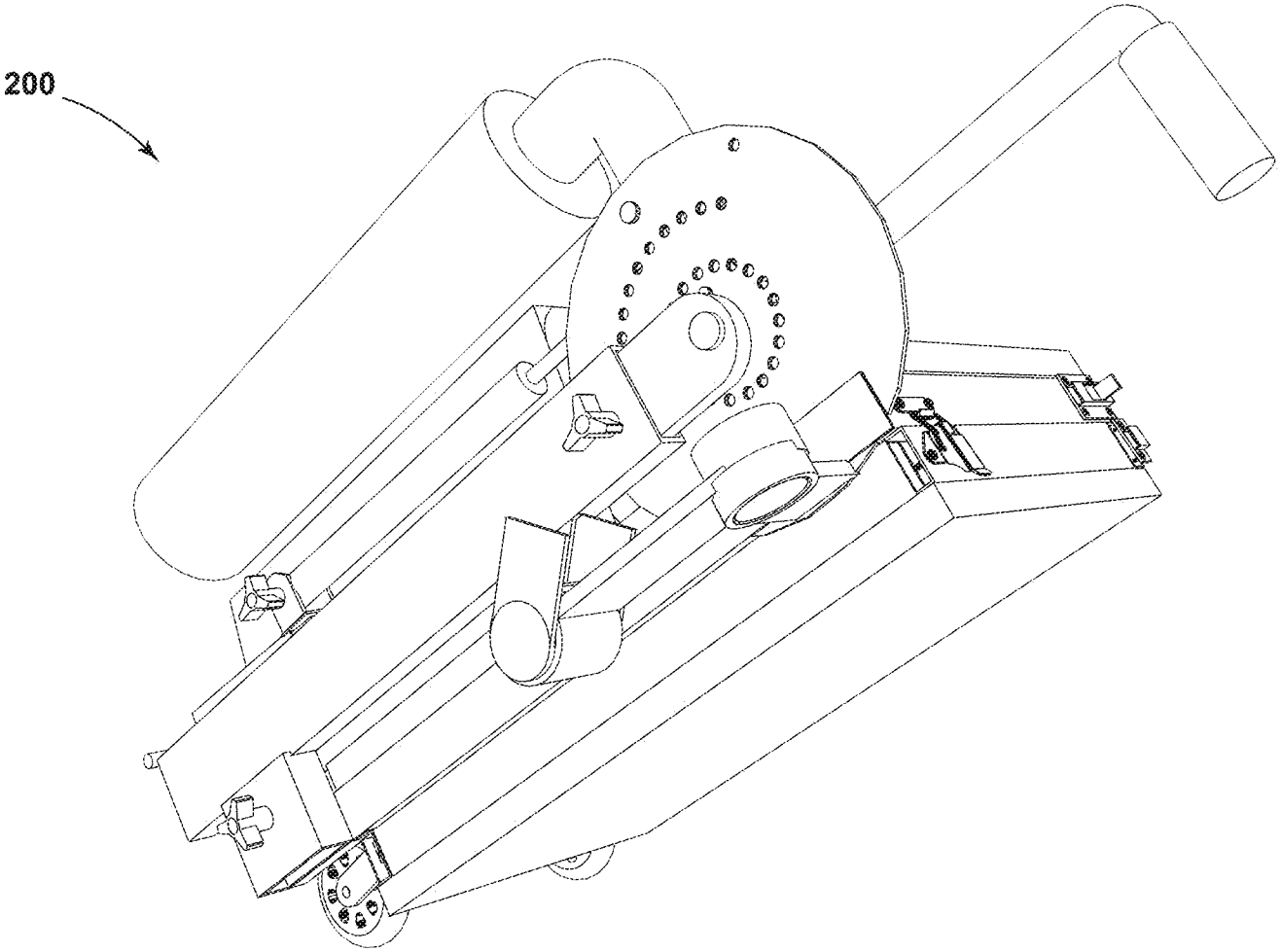
FIG. 11 schematically illustrates a side perspective view of an embodiment of a floor-mounted physical exercise machine that is arranged a compacted or folded configuration, in accordance with the disclosure.

FIGS. 9, 10, and 11 schematically illustrate details related to another embodiment of a physical exercise machine 200, which includes a base 60 including a horizontally disposed frame 64, a single vertical post 67, a horizontal base extension 66, a collapsible seat cushion 65 and a back support pad 18. An embodiment of the user exercise system 20 includes movable horizontal arm 2 coupled to rotation retaining plate 39, and mechanical load system 1. This embodiment of the physical exercise machine 200 is designed to be placed and used on a flat surface, such as a floor area or a tabletop. There is no footplate or kneepad assembly in this embodiment.

The user exercise system 20 is mounted on the first vertical post 5. The user exercise system 20 has a horizontal pivot arm 2 that is coupled to a mechanical load system 1.

The horizontal pivot arm 2 is vertically rotatably coupled to the mechanical load system 1. The horizontal pivot arm 2 is adjustable to one of a first vertical position or a second vertical position relative to the seat 65, wherein the first vertical position is proximal to a lumbar region of a user when disposed on the seat 65, and wherein the second vertical position is proximal to a cervical region of the user when disposed on the seat 65. The mechanical load system 1 is controllable to urge a mechanical resistance in opposition to a force being exerted on the horizontal pivot arm 2, wherein the force being exerted on the horizontal pivot arm 2 may be in the form of a user who is engaged in an exercise routine. The horizontal pivot arm 2 of the user exercise system 20 is also rotatable in a horizontal plane to either an in-use position (as shown) or a rest position. This ability to rotate the horizontal pivot arm 2 in the horizontal plane facilitates user ingress/egress to the seat 65 prior to beginning an exercise routine and after completing an exercise routine.

The horizontal base extension 66 is extendable from the frame 64 behind the seat 65. The rotation retaining plate 39 is rotatably coupled to the single vertical post 67. In one embodiment, the mechanical load system 1 includes a piston 37 that extends between a distal end of the horizontal base extension 66 and an off-center or eccentric connection point 38 on the rotation retaining plate 39. One end of the piston 37 is secured to the rotation retaining plate 39 at eccentric connection point 38 via an attachment pin. The mechanical load system 1 is arranged to exert a mechanical resistance to a force being exerted on the horizontal pivot arm 2.

The frame 64 is divided into first and second frame portions 64A and 64B, respectively, which are joined at hinge 81. Frame 64 supports the seat cushions 65 and provides the base on which the horizontal base extension 66, the vertical post 67, back support base extension 69 and the wheel attachment brackets 53 are attached. Seat cushion 65 is a cushioned pad or upholstered seat that attaches to the back support base adjustment bracket 70 and provides a place for the user to sit. Seat cushion 65 is divided into first and second portions 65A and 65B, respectively, which correspond to the first and second frame portions 64A and 64B, respectively. The first frame portion 64A and the first seat portion 65A are coplanar with the second frame portion 64B and the second seat portion 65B when the exercise machine 200 is arranged in an in-use state. This is depicted with reference to FIGS. 9 and 10. The first frame portion 64A and the first seat portion 65A are arranged in parallel with the second frame portion 64B and the second seat portion 65B when the exercise machine 200 is arranged in a collapsed state, such as for transportation. This is depicted as element 200 and shown with reference to FIG. 11.

The back support pad 18 and the first and second seat portions 65A, 65B form collapsible seat 65.

Horizontal base extension 66 is attached to the frame 64 via the extension pin 72, and extends when the device 200 is deployed to create a connection point for the piston extension bracket 68 and all of the components that are connected to that part directly or indirectly, including the piston adjustment tube (upper) 56, piston adjustment tube (lower) 57, piston adjustment handle 58, attachment pin 35, piston attachment bracket 36, and piston 37. The horizontal base extension 66 includes a member that is able to telescopically collapse into one of the rails of the frame 64 for ease of storage and stowage.

The single vertical post 67 is attached to the frame 64 via the base bracket 75 and includes a housing from which the horizontal pivot arm pivot mount 40 may be moved up and down the y-axis, which in turn allows the mechanical load system 1 to be adjusted up and down in the y-axis.

Piston extension bracket 68 is attached to the horizontal base extension 66 via the extension pin 72, and to the piston adjustment tube (lower) 57, providing a lower anchor point for the piston 37.

Back support base extension 69 is attached to the frame, via the extension pin 72, it extends when the device is deployed to allow the back support base adjustment bracket 70 to move forward and backward along the back support base extension 69 (in the z-axis). This allows the device to firmly support the back of users of various sizes.

Back support base adjustment bracket 70 is attached to the back support base extension 69 by the back support pin 73.

Piston bracket pin 71 is used to attach the piston extension bracket 68 to the horizontal base extension 66.

Piston extension pin 72 is used to attach the horizontal base extension 66 to the frame 64.

Back support pin 73 is used to attach the back support base adjustment bracket 70 to the back support base extension 69.

Electronic interface device or tablet base bracket 74 is used to attach the Controller 19, tablet or electronic interface device and position it so that the Controller 19, tablet or electronic interface device does not prevent exercise.

Adjustment base bracket 75 attaches the single vertical post 67 to the frame 64 via the pin 76. This bracket may include a swiveling feature, which allows the single vertical post 67 to rotate into a horizontal position for transport.

Pin 76 is used to attach the adjustment base bracket 75 to the single vertical post 67.

Latch lower 77 is used to latch the two halves of the frame 64 together during transport. The latch lower 77 connects to latch upper 80 via a ring on the latch upper that loops over an upturned lip or catch on the latch upper 80, such that when pressure is applied to the latch lower, the two parts are drawn together and lock into place, preventing movement. Other embodiments of latch mechanisms may be employed.

Sliding latch catch 78 is used to latch the two halves of the frame 64 together during use to prevent accidental closure. The sliding latch bolt 79 slides into the Sliding latch Catch 78 to prevent the rotation of the two frame halves 64A, 64B. Other sliding latch mechanisms may be employed.

Sliding latch bolt 79 is used to latch the two halves of the frame 64 together during use to prevent accidental closure. The sliding latch bolt 79 slides into the Sliding latch Catch 78 to prevent the rotation of the two frame halves 64.

Latch upper 80 is used to latch the two halves of the frame 64 together during transport. The latch lower 77 connects to the latch upper 80 via a ring on the latch upper that loops over an upturned lip or catch on the latch upper 80, such that when pressure is applied to the latch lower 77, the two parts are drawn together and lock into place, preventing movement.

Hinges 81 are used to connect the two halves of the frame 64 together, while allowing the two halves of the frame 64 to be folded for transport. Although shown in a configuration where the hinges leave the padded surface of the seat cushion 65 exposed, the hinges may also be configured such that the padded surface of the Seat cushion 65 may be sandwiched between the two halves of the frame 64.

The physical exercise machine described herein is adjustable, to allow the exercise of both cervical muscles and lumbar muscles in one device.

The physical exercise machine described herein has a seat which is adjustable to accommodate variously sized users.

The physical exercise machine described herein provides a machine whose knee restraint system may be adjusted to accommodate variously sized users.

The physical exercise machine described herein provides a machine whose footrest system may be adjusted to accommodate variously sized users.

The physical exercise machine described herein is easily transportable to allow home use of the device. This may include reducing the physical size of the machine by designing it to be folded or retracted to a smaller footprint for transportation than when in use.

Some embodiments of the physical exercise machine may allow the device to operate with the use of pre-loaded compressed air pistons (pneumatic pistons), hydraulic pistons, electromechanical resistance, mechanical gearing, electromechanical or mechanical brake mechanism or other means that will provide resistance or adjustable resistance to the user, in order to strengthen the lumbar or cervical muscles.

In some embodiments, the resistance arm may be arranged to be in parallel with a user's spine.

In some embodiments, the mechanical load system may be configured to provide active force to induce extension or flexion in other joints of the body.

In some embodiments, the controller 19 is configured to control the mechanical load system 1 to control magnitude of the force resistance and range of motion limits.

In some embodiments, the controller 19 is configured to monitor and capture usage information, such as frequency of use, duration of use, history of use, range of motion information, resistance levels and range of motion or strength improvement over time.

In some embodiments, the controller 19 is configured to set up and execute training routines or regimens for the user.

The embodiments of the physical exercise machine described herein advantageously employ pre-loaded compressed air pistons (pneumatic pistons), hydraulic pistons, electromechanical resistance, mechanical gearing, electromechanical or mechanical brake mechanism to provide resistance or adjustable resistance to the user. This results in the system being lighter in weight than systems employing weights. This independence from the need to have a stack of weights, plates of weights or individual weights makes this device portable, so that it may be readily used in the home. Embodiments of the physical exercise machine 100 are easily transportable to allow in-home use, or use by physiotherapists who work with multiple users at various locations. Furthermore, the physical exercise machine 100 may be easily transported into the home environment and within the home environment, e.g., into and out of a storage room.

This controller may also be mounted on the electronic interface device or tablet base bracket 74 which is attached to the frame 64 of the floor mounted device.

In the embodiments that uses electromechanical resistance, either through direct electro-mechanical resistance or through electro-mechanical induced braking, setting the resistance level, number of repetitions and starting and stopping position may be controlled by the controller 19. This information may be captured along with the number of repetitions, level of resistance, frequency of activity, duration of activity (length of use), Range of Movement for Extension and Flexion, improvement over time and other metrics.

For the embodiments that use means of resistance other than electromechanical resistance, the controller may still be used to measure number of repetitions, level of resistance, frequency of activity, duration of activity (length of use), Range of Movement for Extension and Flexion, improvement over time and other metrics either input by the user directly, or captured through sensors S2. Transducers may be added to the rotation retaining plate 39 to capture repetition data and resistance data.

Additionally, the electronic computerized instructional device or application linked to the device may be used in order to set up training routines or regimens for the user.

The Rotation stop-pin 55 prevents the device from exceeding a predetermined extension limit by coming into contact with Horizontal pivot arm pivot mount 40 on the piston machine or the Rotation stop arm 63 on the arm electromechanical machine.

Additional embodiments may provide active force rather than resistance to force extension or flexion in other joints of the body such as wrist, elbow, knee, ankle or shoulder through the use of electromechanical force and variations on the current embodiments.

By releasing attachment pins, the piston may be removed from the device and changed out to another piston of different resistance to allow higher or lower resistance levels, depending on how much gas has been preloaded into the piston.

The horizontal pivot arm is arrangeable to contact a back or side portion of the user's neck when the user is disposed on the seat; and wherein the resistance device is arranged to resist motion of a user exerting a force on the horizontal pivot arm. The disclosure includes devices and methods for isolating the muscles in cervical neck area to enable the cervical neck muscles to be exercised without aid or interference from the other muscles.

The term "controller" may include a personal computer, tablet, cellular phone, or other device capable of one or more of the following functions: interfacing with a user via audible voice, hand gesturing, touch, or other means; capturing information from one or more sensors, compiling and/or analyzing information; controlling one or multiple actuators; and communicating with other devices. The term "controller" and related terms such as microcontroller, control, control unit, processor, etc. refer to one or various combinations of Application Specific Integrated Circuit(s) (ASIC), Field-Programmable Gate Array(s) (FPGA), electronic circuit(s), central processing unit(s), e.g., microprocessor(s) and associated non-transitory memory component (s) in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning, buffer circuitry and other components, which may be accessed by and executed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms, and similar terms mean controller-executable instruction sets including calibrations and look-up tables. Each controller executes control routine(s) to provide desired functions. Routines may be executed at regular intervals, for example every 100 microseconds during ongoing operation. Alternatively, routines may be executed in response to occurrence of a triggering event. Communication between controllers, actuators and/or sensors may be accomplished using a direct wired point-to-point link, a networked communication bus link, a wireless link, or another communication link. Communication includes exchanging data signals, including, for example, electrical signals via a conductive medium; electromagnetic signals via air; optical signals via optical waveguides; etc. The data signals may include discrete, analog and/or digitized analog signals representing inputs from sensors, actuator commands, and communication between controllers.

The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

A parameter is defined as a measurable quantity that represents a physical property of a device or other element that is discernible using one or more sensors and/or a physical model. A parameter may be a discrete value (e.g., either "1" or "0"), a percentage (e.g., 0% to 100%), or an infinitely variable value.

Figure 12:
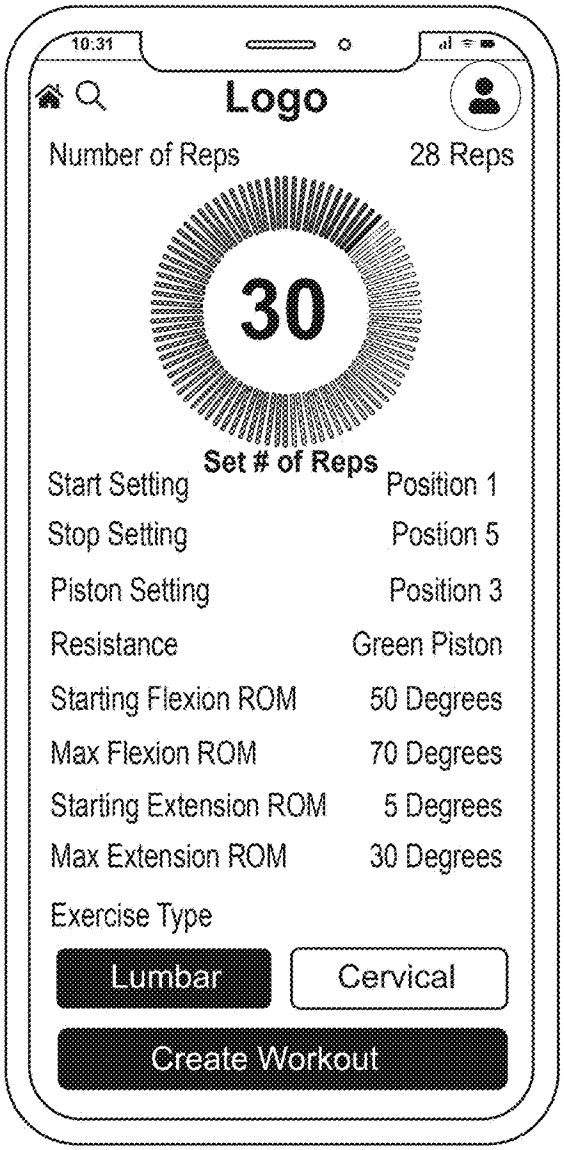
FIG. 12 pictorially illustrates an embodiment of a first screen shot that may be generated by a controller application that is designed to operate on a controller to interact with a mechanical load system of an embodiment of the physical exercise machine described herein, in accordance with the disclosure.
Figure 13:
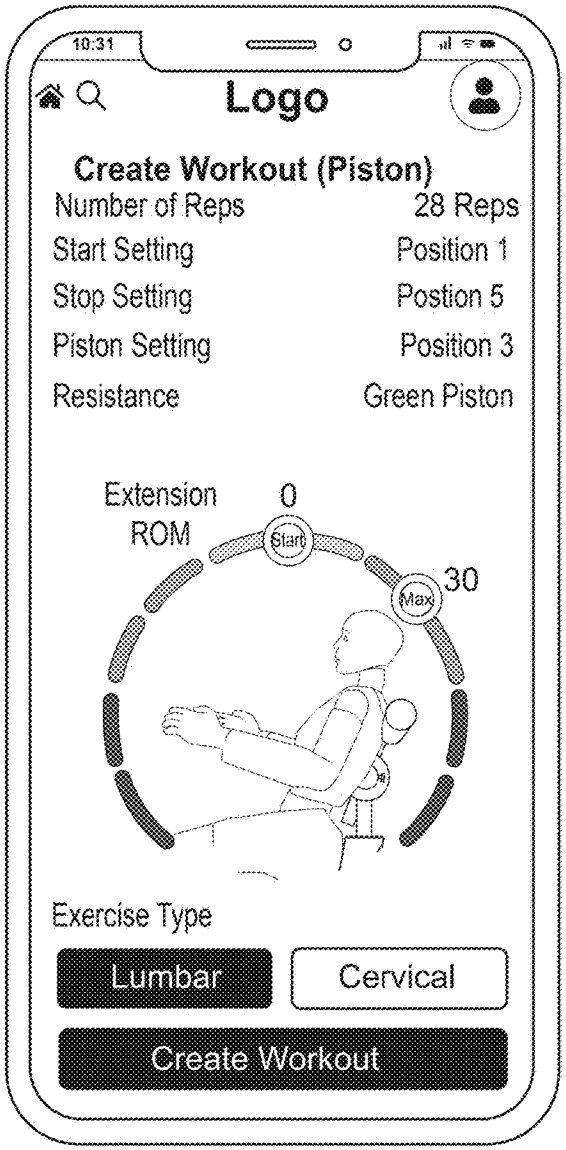
FIG. 13 pictorially illustrates an embodiment of a second screen shot that may be generated by a controller application that is designed to operate on a controller to interact with a mechanical load system of an embodiment of the physical exercise machine described herein, in accordance with the disclosure.
Figure 14:
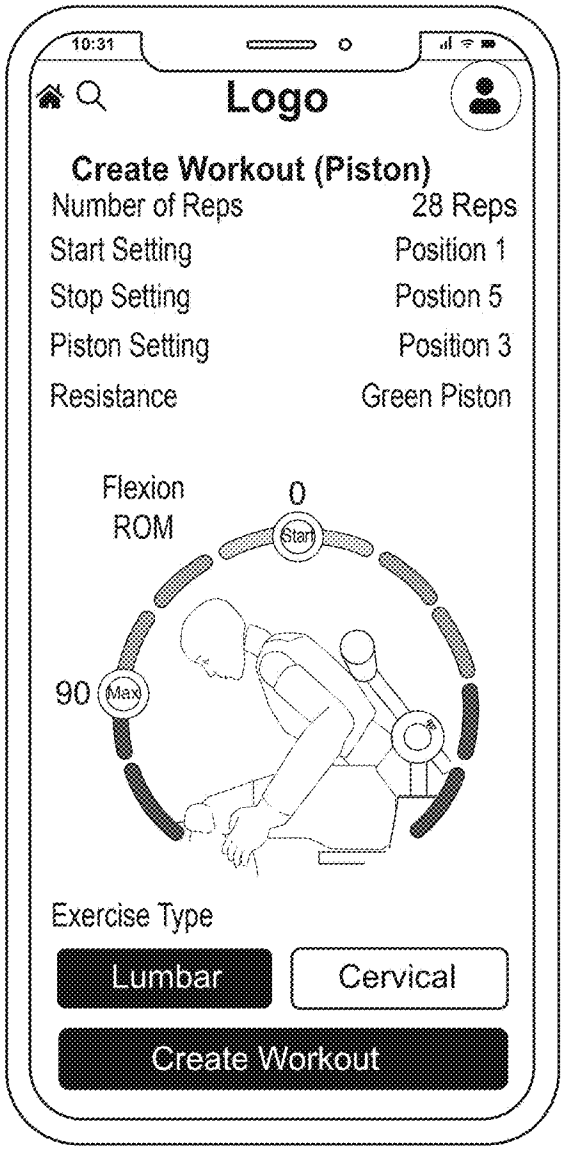
FIG. 14 pictorially illustrates an embodiment of a third screen shot that may be generated by a controller application that is designed to operate on a controller to interact with a mechanical load system of an embodiment of the physical exercise machine described herein, in accordance with the disclosure.

FIGS. 12, 13, and 14 depict screen shots that may be generated by a controller application that is designed to operate on controller 19, which may be a personal computer, tablet, cellular phone, or other device.

FIG. 12 depicts an embodiment of a screen shot of controller application 300 that may be generated by a controller application that is designed to operate on controller 19, which interacts with the position sensor, the first actuator, and/or the second actuator of the mechanical load system 1. In use, a user or person overseeing an exercise program is able to create an exercise routine via a screen function of the controller application 300. A user may choose the name, the number of repetitions, the resistance, the start setting, the end setting, the starting flexion Range of Motion (ROM), the maximum flexion Range of Motion (ROM), the starting extension flexion Range of Motion (ROM), the maximum extension Range of Motion (ROM), the exercise type (the region being worked (i.e. lumbar or cervical (neck)) and other exercise metrics (not shown), depending upon whether the mechanical load system 1 employs a piston or an electromechanical device having position sensor, first actuator, and second actuator. This information will be used by the controller 19 to set up the resistance and operating limits for the electro-mechanical version of the device or the piston version of the device, if enabled with sensors. It will be used to set up the usage data metrics for the piston device, if it is not sensor enabled.

FIG. 13 depicts an embodiment of a second screen shot 400 that may be generated by a controller application that is designed to operate on controller 19, which interacts with the position sensor, the first actuator, and/or the second actuator of the mechanical load system 1. The second screen shot 400 is a pictural representation of the extension Range of Motion (ROM) that may be used to set the upper and lower limits of ROM. Using two moveable sliders, one a start and one a maximum, the sliders may be moved along the circumference of the circle to set the starting and maximum ROM positions. This configuration of the ROM limits may be used for both the electromechanical version of the device and the piston version.

FIG. 14 depicts an embodiment of a third screen shot 500 that may be generated by a controller application that is designed to operate on controller 19, which interacts with the position sensor, the first actuator, and/or the second actuator of the mechanical load system 1. The third screen shot 500 is a pictural representation of the flexion Range of Motion (ROM) that may be used to set the upper and lower limits of ROM. Using two moveable sliders, one a start and one a maximum, the sliders may be moved along the circumference of the circle to set the starting and maximum ROM positions. This configuration of the ROM limits may be used for both the electromechanical version of the device and the piston version.

The disclosure relates to gym exercise machines, home exercise devices, lower back physical therapy, neck/cervical physical therapy and home exercise devices and methods for therapeutically and/or rehabilitatively exercising the neck/cervical and lower back or lumbar muscles. It may also be applicable to other muscles and joints of the human body. The embodiments disclosed herein are particularly suitable for home use and shown in an exercise complete position.

The disclosure includes devices and methods for exercising the core body muscles; specifically, contracting and isolating abdominal and back muscle groups and cervical neck muscle groups.

The disclosure includes devices and methods for isolating the muscles in the hips, buttocks, and legs from the lumbar muscles to enable the lumbar muscles to be exercised without aid or interference from the other muscles.

The disclosure includes devices and methods for isolating the muscles in cervical neck area to enable the cervical neck muscles to be exercised without aid or interference from the other muscles.

The disclosure includes devices and methods for exercising lumbar muscles or cervical neck muscles of a user while seated with hips firmly engaged against a hip pad at a rear portion of a seat, and with the legs bent at the knees so that the thighs and calves form a right angle or an acute angle between them. The feet may be positioned on footrests below the knee, with a kneepad assembly being pivoted against the knees. When the footrests and kneepads are positioned, the kneepad assembly is locked in place with a back pad being positioned against the buttocks and back to prevent the hips from being able to move forward or backward. A seatbelt-like strap may also be used to secure the user to the device. When secured, a user is able to exercise by exerting against a rotatable pivot arm having a resistance device that provides resistance to linear or rotational motion of the movement arm, wherein the resistance device is one or more of an electromechanical device, an electro-magnetic device, a mechanical device, an electromechanical linear actuator, a mechanical braking system, one or a plurality of flexible resilient resistance bands, or a pneumatic cylinder, or a hydraulic cylinder.

The machine may also include a controller in the form of an electronic computerized instructional device or application that is linked via wires, radio frequency, infrared, Bluetooth, WiFi, cellular, or another communication system that may enable exercises to be programmed into the machine, including allowing the positioning of the device electronically into the starting and ending positions for exercise, enabling the collection of usage data, and other parameters.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the claims.

What is claimed is:

1. An exercise machine for physical therapy, the exercise machine comprising:

a horizontal base portion, a first vertical post, a second vertical post, a pivotable post, a seat, a footplate, a kneepad assembly; and a user exercise system having a horizontal pivot arm and a mechanical load system;

wherein the first vertical post, the second vertical post, and the pivotable post are affixed to the horizontal base portion;

wherein the seat is affixed to the second vertical post;

wherein the footplate and the kneepad assembly are affixed to the pivotable post;

wherein the pivotable post is arranged to pivot on the horizontal base portion to adjustably position the kneepad assembly in relation to the seat;

wherein the user exercise system is mounted on the first vertical post;

wherein the horizontal pivot arm is vertically rotatably coupled to the mechanical load system;

wherein the horizontal pivot arm is adjustable to one of a first position or a second position relative to the seat, wherein the first position is proximal to a lumbar region of a user disposed on the seat, and wherein the second position is proximal to a cervical region of the user disposed on the seat; and wherein the mechanical load system is controllable to urge a mechanical resistance to a force being exerted on the horizontal pivot arm.

2. The exercise machine of claim 1, further comprising:

a controller in communication with a sensor;

wherein the sensor is arranged to monitor a parameter associated with the horizontal pivot arm;

wherein the controller includes an instruction set, the instruction set being executable to:

monitor the parameter associated with the horizontal pivot arm during an exercise routine; and determine, in real time, progression of the exercise routine based upon the parameter associated with the horizontal pivot arm.

3. The exercise machine of claim 1, further comprising a rotation stop pin connected to the mechanical load system, wherein the rotation stop pin is arranged to control a range of motion of the horizontal pivot arm.

4. The exercise machine of claim 1, further comprising the user exercise system being mounted on the first vertical post such that the user exercise system is rotatable in a horizontal plane to either an in-use position or a rest position.

5. The exercise machine of claim 1, further comprising: a first actuator connected to the mechanical load system, wherein the first actuator is arranged to control a range of motion of the horizontal pivot arm.

6. The exercise machine of claim 1, further comprising: a second actuator connected to the mechanical load system, wherein the second actuator is arranged to control a magnitude of a resistive mechanical force exertable by the mechanical load system on the horizontal pivot arm.

7. The exercise machine of claim 1, further comprising a plurality of casters attached to the horizontal base portion.

8. The exercise machine of claim 1, wherein the second vertical post is configured to be adjustable in a vertical direction in relation to the horizontal base portion.

9. The exercise machine of claim 1, wherein the pivotable post is configured to be adjustable in a vertical direction in relation to the horizontal base portion.

10. The exercise machine of claim 1, wherein the mechanical load system comprises one of a pneumatic piston, a hydraulic piston, an elastomer band, an electromechanical resistance device, mechanical gearing, or a mechanical brake mechanism.

11. An exercise machine, comprising:

a horizontally-disposed frame, a vertical post, a horizontal base extension, a seat including a seat cushion and a back support pad, a first frame portion, and a second frame portion joined at a hinge, wherein the seat cushion includes a first seat portion and a second seat portion;

a user exercise system, including a horizontal pivot arm coupled to a rotation plate, and a mechanical load system; and wherein the horizontal base extension is extendable from the frame behind the seat;

wherein the rotation plate is rotatably coupled to the vertical post;

wherein the mechanical load system is coupled between the horizontal base extension and an eccentric point on the rotation plate;

wherein the mechanical load system is arranged to exert a mechanical resistance to a force being exerted on the horizontal pivot arm via the rotation plate;

wherein the vertical post, seat including seat cushion and back support pad and the user exercise system are collapsible onto the horizontally-disposed frame;

wherein the first seat portion is disposed on the first frame portion and wherein the second seat portion is disposed on the second frame portion;

wherein the first frame portion and the first seat portion are coplanar with the second frame portion and the second seat portion when the exercise machine is arranged in an in-use state; and wherein the first frame portion and the first seat portion are arranged in parallel with the second frame portion and the second seat portion via the hinge when the exercise machine is arranged in a collapsed state.

12. The exercise machine of claim 11, wherein the vertical post is extendable in a vertical direction to adjust a height of the user exercise system in relation to the seat cushion.

13. The exercise machine of claim 11, wherein the exercise machine arrangeable on a horizontal surface.

14. The exercise machine of claim 11, wherein the horizontal base extension comprises a tube portion that is telescopically joined to the horizontally-disposed frame.

15. The exercise machine of claim 11, wherein the mechanical load system comprises a piston that is coupled between the horizontal base extension and the rotation plate.

16. The exercise machine of claim 11, wherein the mechanical load system comprises one of a pneumatic piston, a hydraulic piston, an elastomer band, an electromechanical resistance device, mechanical gearing, or a mechanical brake mechanism.

17. The exercise machine of claim 11, wherein the horizontal pivot arm is adjustable to one of a first position or a second position relative to the seat, wherein the first position is proximal to a lumbar region of a user disposed on the seat, and wherein the second position is proximal to a cervical region of the user disposed on the seat.

18. The exercise machine of claim 11, further comprising the user exercise system being mounted on the vertical post such that the user exercise system is rotatable in a horizontal plane to either an in-use position or a rest position.

19. The exercise machine of claim 11, further comprising:

a controller in communication with a sensor;

wherein the sensor is arranged to monitor a parameter associated with the horizontal pivot arm;

wherein the controller includes an instruction set, the instruction set being executable to:

monitor the parameter associated with the horizontal pivot arm during an exercise routine; and determine, in real time, progression of the exercise routine based upon the parameter associated with the horizontal pivot arm.

* * * * *